US006535193B1

(12) United States Patent
Mizutome et al.

(10) Patent No.: US 6,535,193 B1
(45) Date of Patent: Mar. 18, 2003

(54) DISPLAY APPARATUS

(75) Inventors: Atsushi Mizutome, Kanagawa-ken (JP); Tomoyuki Ohno, Ebina (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/409,067

(22) Filed: Sep. 30, 1999

(30) Foreign Application Priority Data

Oct. 2, 1998 (JP) ..... 10-294698

(51) Int. Cl.[7] ..... G09G 3/36
(52) U.S. Cl. ..... 345/99; 345/100
(58) Field of Search ..... 345/95, 78, 700, 345/102, 132, 112, 208, 77, 211, 213, 99

(56) References Cited

U.S. PATENT DOCUMENTS 5,517,207 A * 5/1996 Kawada et al. ..... 345/78
5,764,225 A * 6/1998 Koshobu ..... 345/211
5,861,863 A * 1/1999 Kudo et al. ..... 345/100
5,933,128 A * 8/1999 Kuribayashi et al. ..... 345/95
5,986,636 A * 11/1999 Wu ..... 345/132
6,097,379 A * 8/2000 Ichiraku ..... 345/213
6,144,355 A * 11/2000 Murata et al. ..... 345/99

* cited by examiner

*Primary Examiner*—Steven Saras
*Assistant Examiner*—Uchendu O. Anyaso
(74) *Attorney, Agent, or Firm*—Fitzpatrick, Cella, Harper & Scinto

(57) ABSTRACT

A display apparatus features a display panel including scanning electrodes and data electrodes arranged in a matrix form, a scanning electrode driver having a first withstand voltage for applying a scanning signal to the scanning electrodes, a data electrode driver having a second withstand voltage for applying a data signal to the data electrodes, and a controller for inputting a scanning electrode drive timing signal into the scanning electrode driver and inputting a data electrode drive timing signal into the data electrode driver. The first withstand voltage and the second withstand voltage are different from each other, and the controller includes a phase adjuster for adjusting a phase of the scanning electrode drive timing signal and/or the data electrode drive timing signal.

6 Claims, 14 Drawing Sheets

DISPLAY APPARATUS

FIELD OF THE INVENTION AND RELATED ART

The present invention relates to a display apparatus including a display device, particularly a display apparatus improved in drive control method of a display device having scanning electrodes and data electrodes arranged in a matrix form.

In recent years, display devices using liquid crystals (e.g., an STN (super twisted nematic) liquid crystal, an FLC (ferroelectric liquid crystal) and an AFLC (anti-ferroelectric liquid crystal)) of, e.g., a single matrix-type and an active matrix-type (using TFTs (thin film transistors) etc.) have been extensively developed in view of a large picture area (size) and a large display capacity (the number of pixels). Specifically, e.g., large-sized display devices (panels) having a diagonal length of 10–14 in. for notebook-type PCs (personal computers) and 13 in. to above 20 in. for monitors of desktop-type PCs and high-definition (resolution) display devices (panels) of XGA mode (1024×768 pixels), SXGA mode (1280×1024 pixels) and UXGA mode (1600×1280 pixels) have been announced.

These display panels have such an electrode structure that scanning electrodes and data electrodes are arranged in a matrix form and generally driven by successively scanning the scanning electrodes in a line-sequential scheme while inputting picture image information (display data) into the data electrodes.

FIG. 4 is a block diagram showing an embodiment of a display apparatus using such a conventional display panel (device).

Referring to FIG. 4, the display apparatus includes a liquid crystal panel 401 having scanning electrodes 1 and data electrodes 2 arranged in a matrix form, a scanning electrode drive circuit 403 for applying scanning signals to the scanning electrodes 1, a data electrode drive circuit 402 for applying data signals to the data electrodes 2, and a panel control circuit 404 for inputting a scanning electrode drive timing signal into the scanning electrode drive circuit 403 and inputting a data electrode drive timing signal into the data electrode drive circuit 402.

Picture image display in the display apparatus is performed based on (picture) image data transmitted from a display data generating unit 405.

Heretofore, the data electrode drive circuit (generally called a segment or source driver) 402 and the scanning electrode drive circuit (generally called a common or gate driver) 403 have been designed according to the same IC (integrated circuit) process rule and have possessed an identical withstand voltage.

However, in more recent years, in order to meet, e.g., a cost reduction of the entire drive circuits and an increase in transfer clock frequency due to an increased display capacity for providing a high definition or resolution, the data electrode drive circuit has been prepared by a minute production process and/or by using driver ICs of lower withstand voltages. As a result, the data electrode drive circuit has included driver ICs having a withstand voltage different from a withstand voltage of driver ICs for the scanning electrode drive circuit in many cases.

In an ordinary simple matrix-type display apparatus using a STN (TN) liquid crystal, the data electrode drive circuit generally has a structure (block diagram) as shown in FIG. 5 and the scanning electrode drive circuit generally has a structure as shown in FIG. 6. For another simple matrix-type display apparatus using an FLC possessing a memory characteristic, the data electrode drive circuit and the scanning electrode drive circuit generally have structures partially different from those (FIGS. 5 and 6) for the display apparatus using the STN (TN) liquid crystal due to different drive waveforms therebetween. However, problematic portions considered in the present invention are substantially common to the STN (TN)-type display apparatus and the FLC-type display apparatus.

As shown in FIGS. 5 and 6, the data electrode drive timing signal comprising a latch signal (LP) for display data and an AC (alternating current)-providing signal (M) for a liquid crystal drive waveform (a timing signal for inverting a polarity of a liquid crystal drive waveform) is inputted into the data electrode drive circuit and the scanning electrode drive timing signal comprises shift clock signal (SCL) and an AC-providing (or polarity-inversion) signal (M) is inputted to the scanning electrode drive circuit. These signals are generally applied in accordance with a time chart as shown in FIG. 9.

Herein, the drive timing signal means a signal for determining a time (or timing) for switching a liquid crystal drive waveform.

In the case where a matrix-type display panel is driven by using these (scanning and data electrode) drive circuits, as shown in FIG. 4, the panel control circuit 404 inputs an identical signal providing a latch signal (LP) for the data electrode drive circuit 402 and a shift clock signal (SCL) for the scanning electrode drive circuit 403 and an identical signal providing an AC-providing signal (M) for the data electrode drive circuit 402 and an AC-providing providing signal (M) for the scanning electrode drive circuit 403, respectively.

In such a case, if parameters regarding an operating speed, such as a withstand voltage of an output stage and a circuit structure of the data electrode drive circuit 402, are identical to those of the scanning electrode drive circuit 403, an outputted data electrode drive waveform and an outputted scanning electrode drive waveform are switched at the same time with an identical delay time based on the above-mentioned drive timing signals transmitted from the panel control circuit 404 as shown in FIG. 7.

Referring to FIG. 7, a delay time td1 is a time from an input of an AC-providing signal (M) to a switching (output) of an actually outputted drive waveform and a delay time td2 is a time from an input of a latch signal (LP) or a shift cock signal (SCL).

A correlation between the delay times td1 and td2 determined based on the signals (M) (LP) and (SCL) is not restricted to that shown in FIG. 7. The delay times td1 and td2 are independent of each other.

Herein, each of the delay times (e.g., td1 and td2) is specifically determined as an interval (duration) of time from a time at which an amplitude of an inputted waveform is changed by 90% thereof (i.e., 100% to 10% for highest level or 0% to 90% for lowest level) to a time at which an amplitude of an outputted waveform is changed by 10% thereof (i.e., 100% to 90% for highest level or 0% to 10% for lowest level) in view of a recognizable level of respective switched waveforms.

With respect to the respective drive timing signals, it is important for times (or timings) of switching of outputted scanning and data electrodes drive waveforms to coincide with each other.

However, e.g., in the case where a withstand voltage of an output stage for a data electrode drive circuit is lower than that of an output stage for a scanning electrode drive circuit while adopting a common connection scheme for drive timing signals as shown in FIG. 4, driver ICs possessing a lower withstand voltage generally provide a quicker (higher) operating speed due to a structure thereof. As a result, as shown in FIG. 8, a data electrode drive waveform outputted from the data electrode drive circuit is switched earlier than a scanning electrode drive waveform outputted from the scanning electrode drive circuit.

Specifically, referring to FIG. 8, delay times for the AC-providing signal (M) td1s (data electrode side) and td1c (scanning electrode side) hold the relationship of: td1s<td1c. Similarly, delay times for the latch signal (LP)/shift clock signal (SCL) td2s (data electrode side) and td2c (scanning electrode side) hold the relationship of: td2s<td2c. Accordingly, when the matrix-type display panel is driven, the outputted scanning electrode drive waveform from the scanning electrode drive circuit and the outputted data electrode drive waveform from the data electrode drive circuit cause a difference in delay times (or switching timing).

A waveform applied to a liquid crystal layer is a composite waveform of the scanning electrode drive waveform and the data electrode drive waveform, so that if times (or timings) of switching of the scanning electrode drive waveform and the data electrode drive waveform are different from each other, electrodes (scanning electrodes and data electrodes) within the display panel and liable to be accompanied with noises and the liquid crystal layer is liable to be not supplied with a proper voltage waveform in a selection period. As a result, display qualities are lowered and particularly, good picture images are not stably displayed over the entire display area in terms of a change in operating environments etc.

In the active matrix (TFT)-type display apparatus, output terminals of a scanning electrode drive circuit are connected to gate lines (electrodes) of TFTs provided within a liquid crystal display panel and those of a data electrode drive circuit are connected to source lines of the TFTs.

In the display apparatus, a gate pulse (signal) is successively supplied from the scanning electrode drive circuit to the gate (scanning) lines every one gate line, thus turning an associated TFT "ON" along a scanning line and writing therein picture image information (display data) from the data electrode drive circuit at the same time. Accordingly, if a drive timing of the scanning electrode drive circuit is different from that of the data electrode drive circuit, a writing operation is liable to become insufficient in a selection period and a so-called crosstalk phenomenon such that an image data along a scanning line is also supplied to another (adjacent) scanning line is liable to occur.

SUMMARY OF THE INVENTION

In view of the above-mentioned problems, an object of the present invention is to provide a display apparatus, particularly a matrix-type liquid crystal display apparatus, capable of applying a proper drive waveform (composite waveform) to a liquid crystal layer even when the display apparatus is driven by using a combination of a scanning electrode drive circuit and a data electrode drive circuit providing different withstand voltages leading to different operating speeds.

According to the present invention, there is provided a display apparatus, comprising:

a display panel including scanning electrodes and data electrodes arranged in a matrix form, scanning electrode drive means having a first withstand voltage for applying a scanning signal to the scanning electrodes, data electrode drive means having a second withstand voltage for applying a data signal to the data electrodes, and control means for inputting a scanning electrode drive timing signal into the scanning electrode drive means and inputting a data electrode drive timing signal into the data electrode drive means, wherein the first withstand voltage and the second withstand voltage are different from each other and the control means comprises phase-adjusting means for adjusting a phase of the scanning electrode drive timing signal and/or the data electrode drive timing signal.

In the above display apparatus of the present invention, the phase-adjusting means adjusts a phase of the scanning electrode drive timing signal and/or a phase of the data electrode drive timing signal so as to match a switching timing of a drive waveform for the scanning signal with that of a drive waveform for the data signal, whereby an appropriate (or proper) drive waveform (composite waveform) is applied to a display panel to provide good image qualities.

This and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

In the present invention, the phase-adjusting means may preferably adjust a phase of the scanning electrode drive timing signal and/or the data electrode drive timing signal so as to match a switching timing of a scanning electrode drive waveform for the scanning signal with that of a data electrode drive waveform for the data signal. Further, the phase-adjusting means may preferably adjust phases of the scanning electrode drive timing signal and the data electrode drive timing signal so that the phase of the scanning electrode drive timing signal precedes that of the data electrode drive timing signal. Further, in a preferred embodiment, the scanning electrode drive timing signal or the data electrode drive timing signal includes a plurality of timing signals and the phase-adjusting means adjusts respective phases of the plurality of timing signals independently of each other.

The phase-adjusting means may preferably include delay means for delaying the scanning electrode drive timing signal and outputting the scanning electrode drive timing signal as the data electrode drive timing signal. Alternatively, the phase-adjusting means may preferably include first delay means for delaying a first signal for a first delay time and outputting the first signal as the data electrode drive timing signal and second delay means for delaying a second signal for a second delay time and outputting the second signal as the scanning electrode drive timing signal, and the first delay means may preferably be capable of setting the first delay time independently of the second delay means capable of setting the second delay time.

Hereinbelow, the present invention will be described more specifically based on Examples with reference to the drawings.

EXAMPLE 1

Figure 1:
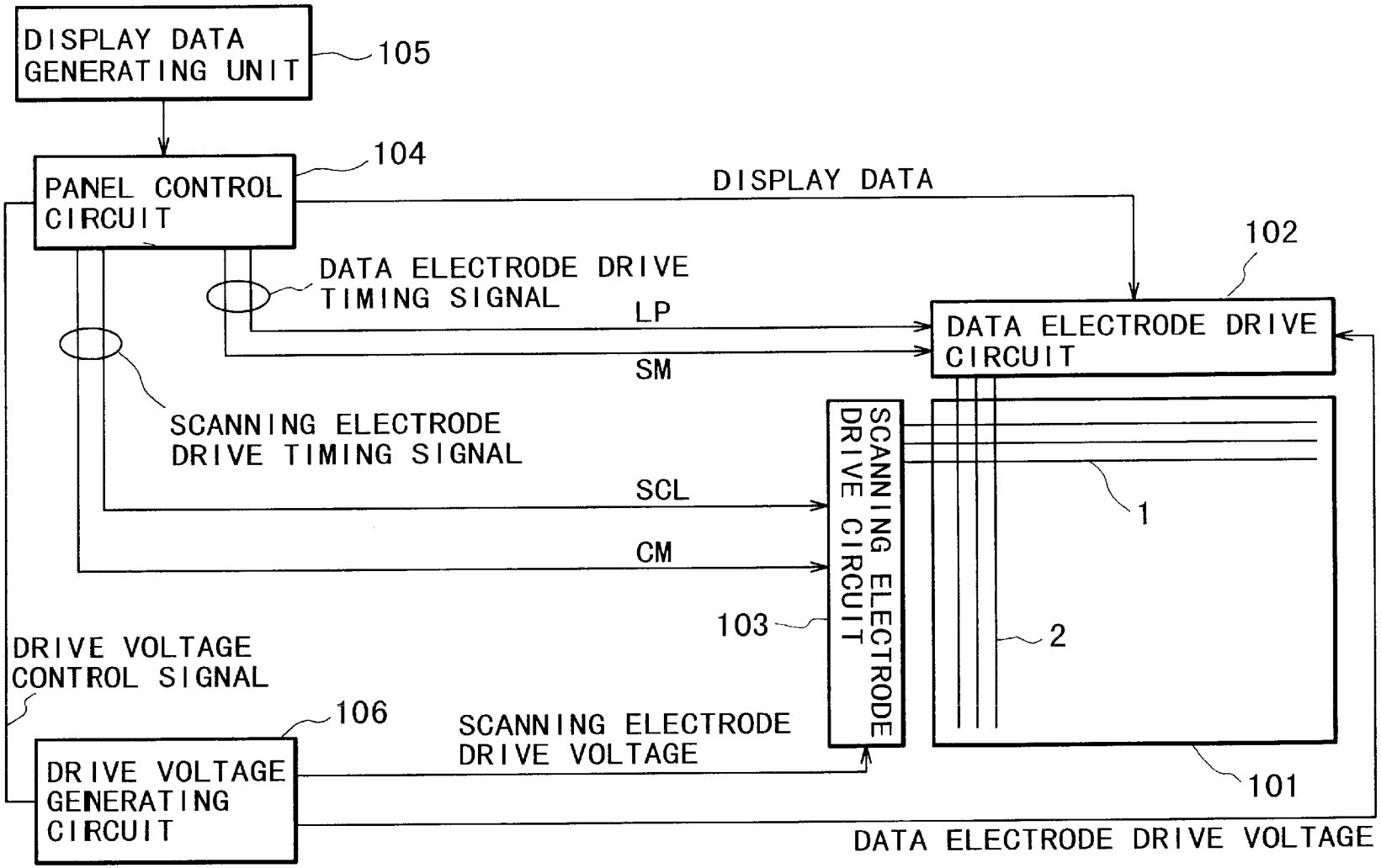
FIG. 1 is a block diagram for illustrating a structure of a liquid crystal display apparatus according to the present invention used in Example 1 appearing hereinafter.

FIG. 1 shows a block diagram of a structure of a simple matrix-type STN (TN) liquid crystal display apparatus according to the present invention used in this example.

The display apparatus includes a display panel 101 including scanning electrodes 1 and data electrodes 2 arranged in a matrix form, scanning electrode drive circuit 103 for applying a scanning signal to the scanning electrodes 1, data electrode drive circuit 102 for applying a data signal to the data electrodes 2, and panel control circuit 104 for inputting a scanning electrode drive timing signal into the scanning electrode drive circuit 103 and inputting a data electrode drive timing signal into the data electrode drive circuit 102. The panel control circuit 104 includes a timing (delay time)-adjusting circuit as phase-adjusting means (described later) for adjusting a phase of the scanning electrode drive timing signal or the data electrode drive timing signal.

The display apparatus further includes a display data generating circuit 105 from which display data and control signals (such as horizontal and vertical synchronizing signals, transfer clock and blanking pulse) are transmitted to the panel control circuit 104. The panel control circuit 105 transmits the display data to the data electrode drive circuit 102 and provides various timing signals, determined based on the control signals from the display data generating unit 105, to the data electrode drive circuit 102 and the scanning electrode drive circuit 103. The data electrode drive timing signal and the scanning electrode drive timing signal constitute a part of such control signals. In FIG. 1, control signals other than the data electrode drive timing signal and the scanning electrode drive timing signal are omitted. The data and scanning electrode drive timing signals are more specifically described later.

The display apparatus further includes a drive voltage generating circuit 106 which generates a prescribed scanning electrode drive voltage and a prescribed data electrode drive voltage based on a drive voltage control signal transmitted from the panel control circuit 104 and supplies these (scanning and data electrode) drive voltages to the scanning electrode drive circuit 103 and the data electrode drive circuit 102, respectively. The scanning electrode drive circuit 103 and the data electrode drive circuit 102 generate a scanning electrode drive waveform and a data electrode drive waveform, respectively, based on the respective drive voltage from the drive voltage generating circuit 106 and various timing signals and display data from the panel control circuit 104, thus driving the liquid crystal panel 101 at a prescribed frame frequency and a drive voltage.

In this example, the scanning electrode drive circuit 103 comprises driver ICs possessing a withstand voltage of 60 volts and the data electrode drive circuit 102 comprises driver ICs possessing a withstand voltage of 10 volts.

The liquid crystal panel 101 comprises a simple matrix-type liquid crystal panel wherein the scanning electrodes and data electrodes each formed on a glass substrate intersect each other to form a plurality of pixels each at an intersection (i.e., a matrix form). The liquid crystal panel 101 has a display area of ca. 13 in. (diagonal length) and 1024×768 pixels (XGA mode) and is driven by using a set of drive waveforms (including a scanning electrode drive waveform and data electrode drive waveform) as shown in FIG. 9.

Figure 9:
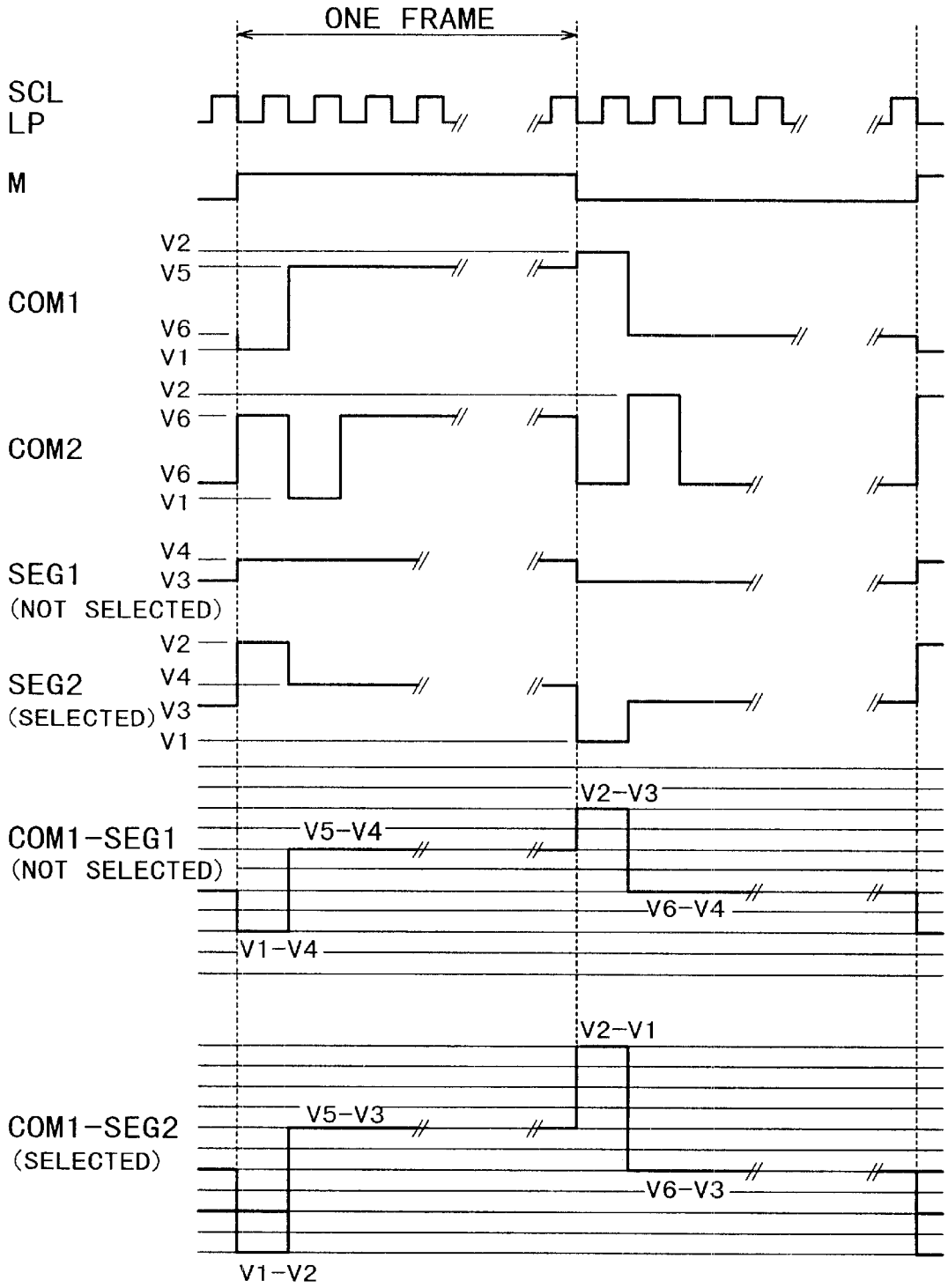
FIG. 9 is an embodiment of a set of drive waveforms for a simple embodiment of a set of drive waveforms for a simple matrix-type STN (TN) liquid crystal display panel.

Referring to FIG. 9, COM1 and COM2 represent first and second scanning electrode drive waveforms, respectively. SEG1 and SEG2 represent non-selection and selection data electrode drive waveforms outputted from the data electrode drive circuit 102, respectively, in a selection period (1H: one horizontal scanning period) based on display data for "OFF" and "ON" states.

Respective voltages V1–V6 are supplied from the drive voltage generating circuit 106 (shown in FIG. 1) and vary depending on drive voltage control signals transmitted from the panel control circuit 104.

Figure 4:
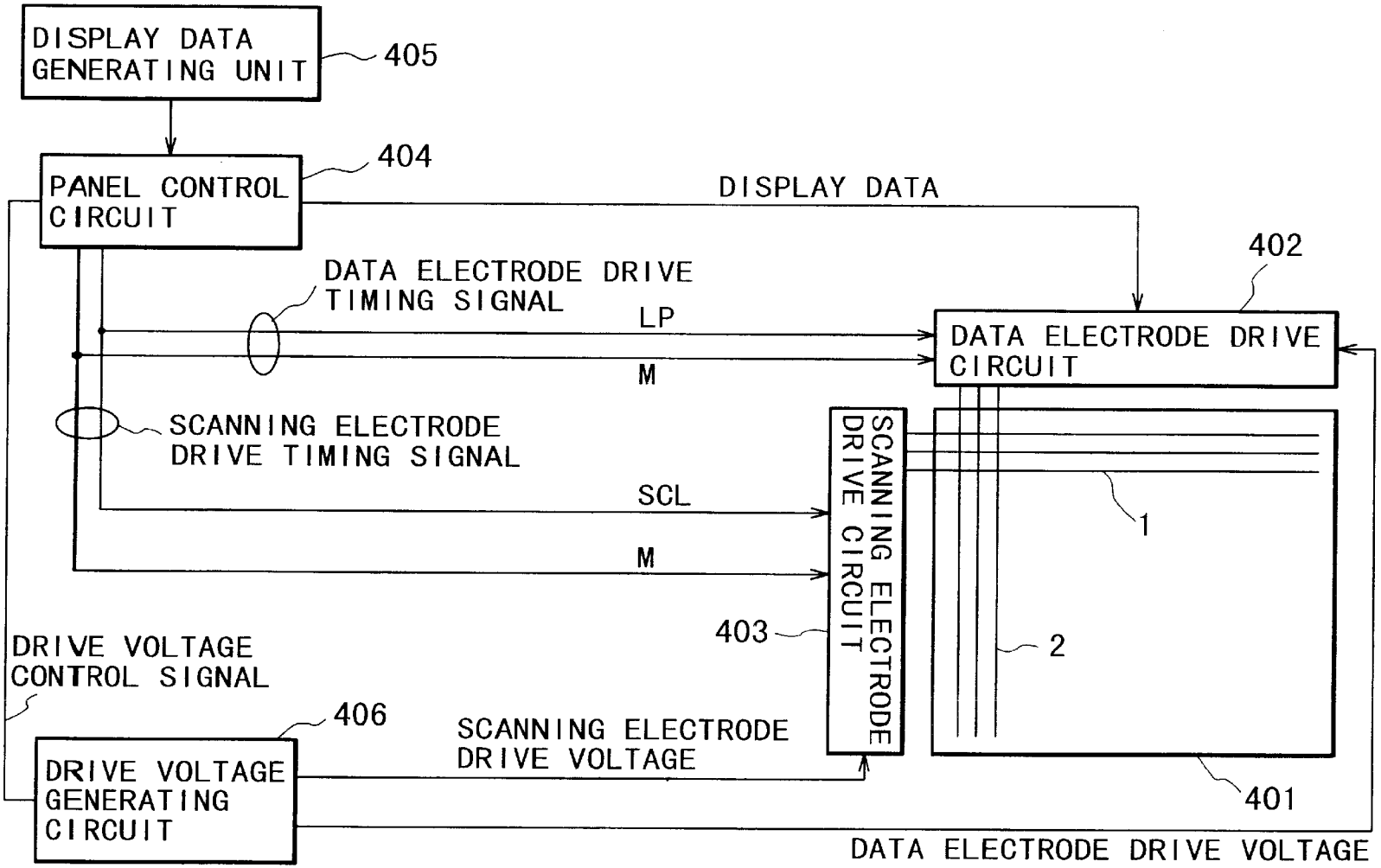
FIG. 4 is a block diagram for illustrating a structure of a conventional liquid crystal display apparatus.
Figure 5:
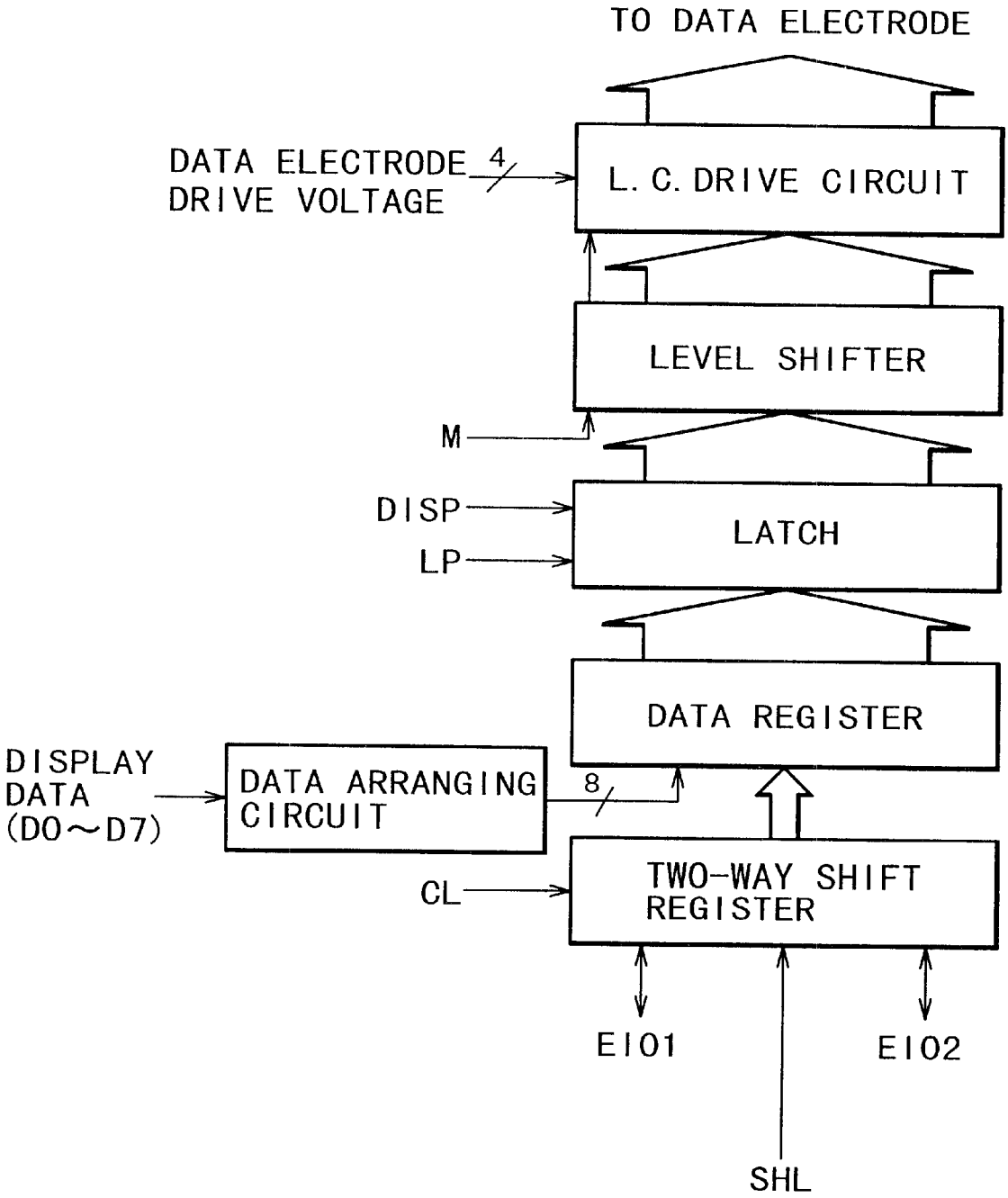
FIGS. 5 and 6 are views for illustrating embodiments of a data electrode drive circuit and a scanning electrode drive circuit, respectively, of an ordinary signal matrix-type STN (TN) liquid crystal display panel.
Figure 6:
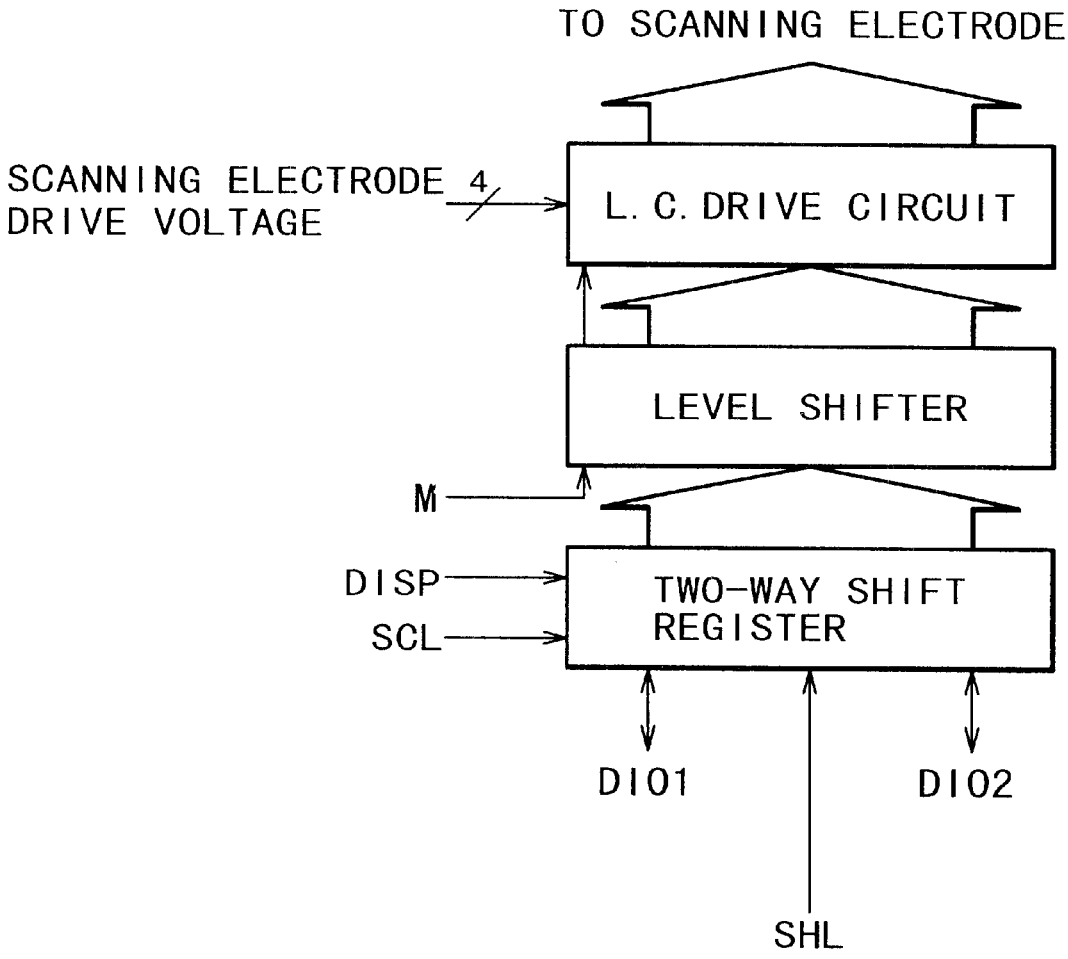
Figure 7:
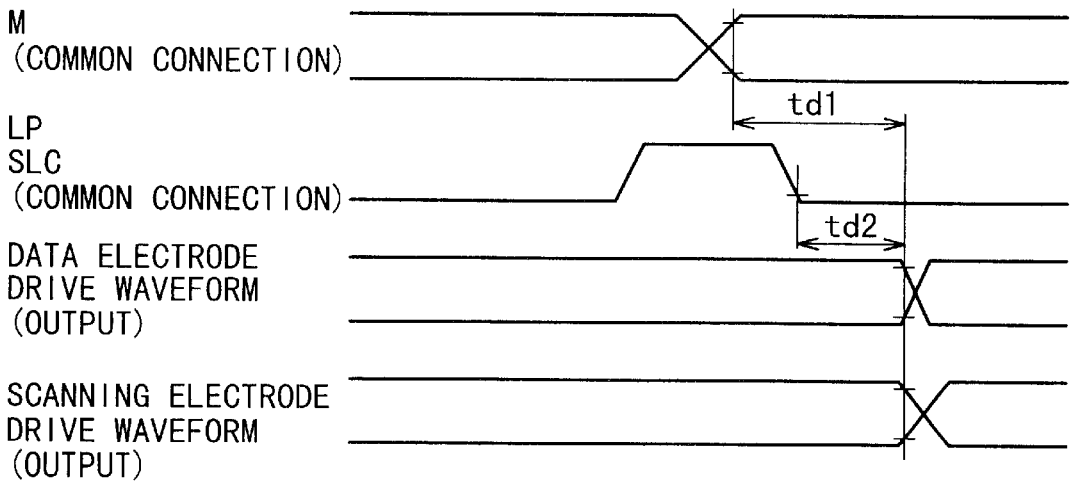
FIGS. 7 and 8 are time charts for illustrating time correlations between drive timing signals and drive waveforms in the case of using a data electrode drive circuit (IC) and a scanning electrode drive circuit (IC) having an identical withstand voltage (operating speed) and in the case of using those having different withstand voltages (operating speeds), respectively.
Figure 8:
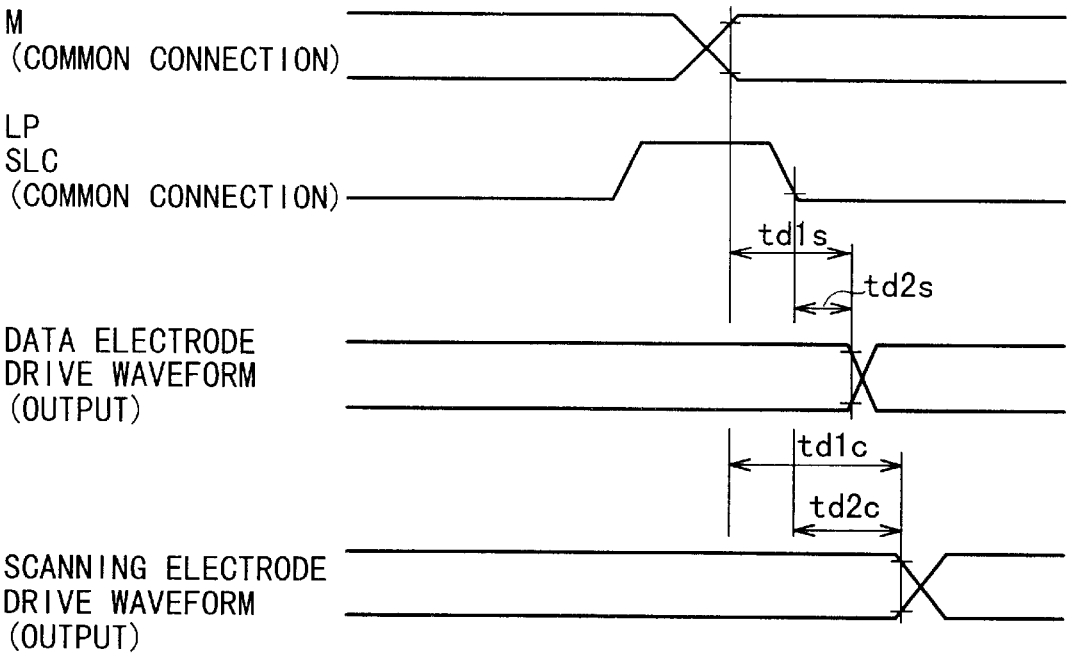

Referring again to FIG. 1, the data electrode timing signal comprising a latch signal (LP) and a data electrode AC-providing (polarity-inversion) signal (SM) is separated from the scanning electrode timing signal comprising a shift clock signal (SCL) and a scanning electrode AC-providing (polarity-inversion) signal (CM). The present invention is characterized by such a separation (division) of the data electrode timing signal and the scanning electrode timing signal, which is different from the conventional common timing signal as shown in FIG. 4.

The respective (data and scanning electrode) timing signals are independently inputted into the data electrode drive circuit 102 and the scanning electrode drive circuit 103, respectively. Specifically, the latch signal (LP) and shift clock signal (SCL) using an identical signal (or transmitted at the same time) in the conventional manner (FIG. 4) are separated into independent two signals (LP and SCL) and transmitted to the data electrode drive circuit 102 and the scanning electrode drive circuit 103, respectively. Similarly, the conventional common AC-providing signal (FIG. 4) is also separated into independent two AC-providing signals (SM and CM) and transmitted to the data electrode drive circuit 102 and the scanning electrode drive circuit 103, respectively.

Figure 2:
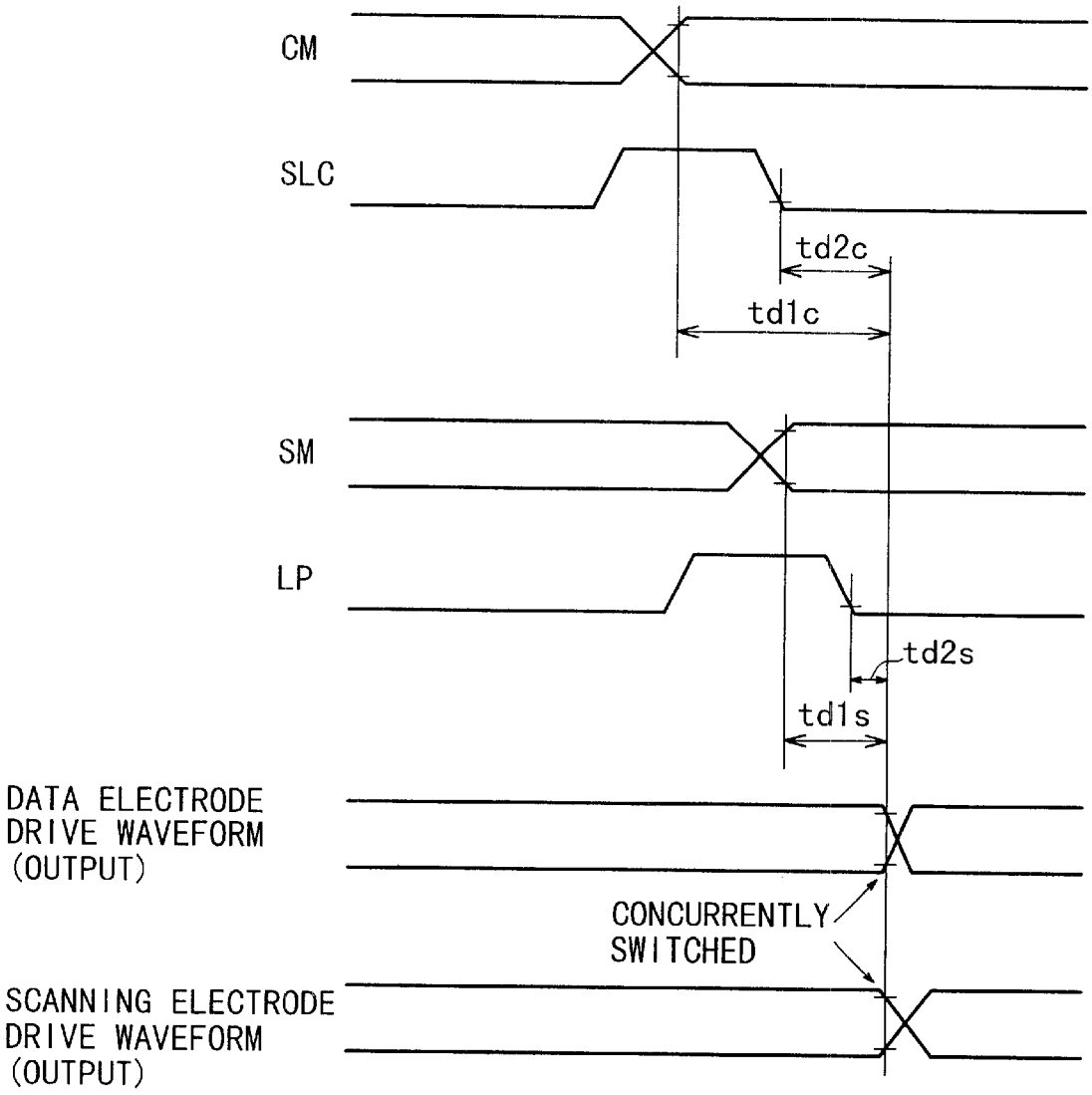
FIG. 2 is a time chart for illustrating a time correlation between drive timing signals and drive waveforms for the display apparatus shown in FIG. 1.

FIG. 2 is a time chart representing a time correlation between (inputted) drive timing signals and (outputted) drive waveforms in this example.

Referring to FIG. 2, the scanning electrode AC-providing signal (CM) and the shift clock signal (SCL) inputted into the scanning electrode drive circuit 103 as the scanning electrode drive timing signal provide a delay time td1c and a delay time td2c, respectively. On the other hand, the data electrode AC-providing signal (SM) and the latch signal (LP) inputted into the data electrode drive circuit 102 as the data electrode drive timing signal provide a delay time td1s and a delay time td2s, respectively. These delay times td1s and td2s regarding the data electrode drive waveform are shorter than the delay times td1c and td2c regarding the scanning electrode drive waveform, respectively. In this example, in view of the differences in delay times, the data electrode drive timing signal (SM and LP) providing the data electrode drive waveform is inputted later than the scanning electrode drive timing signal (CM and SCL) so as to match a switching (output) timing of the data electrode drive waveform with that of the scanning electrode drive waveform. The control and adjustment of these timing signals (CM, SM, LP and SCL) are performed by the timing (delay time)-adjusting circuit provided to the panel control circuit 104.

Figure 3A:
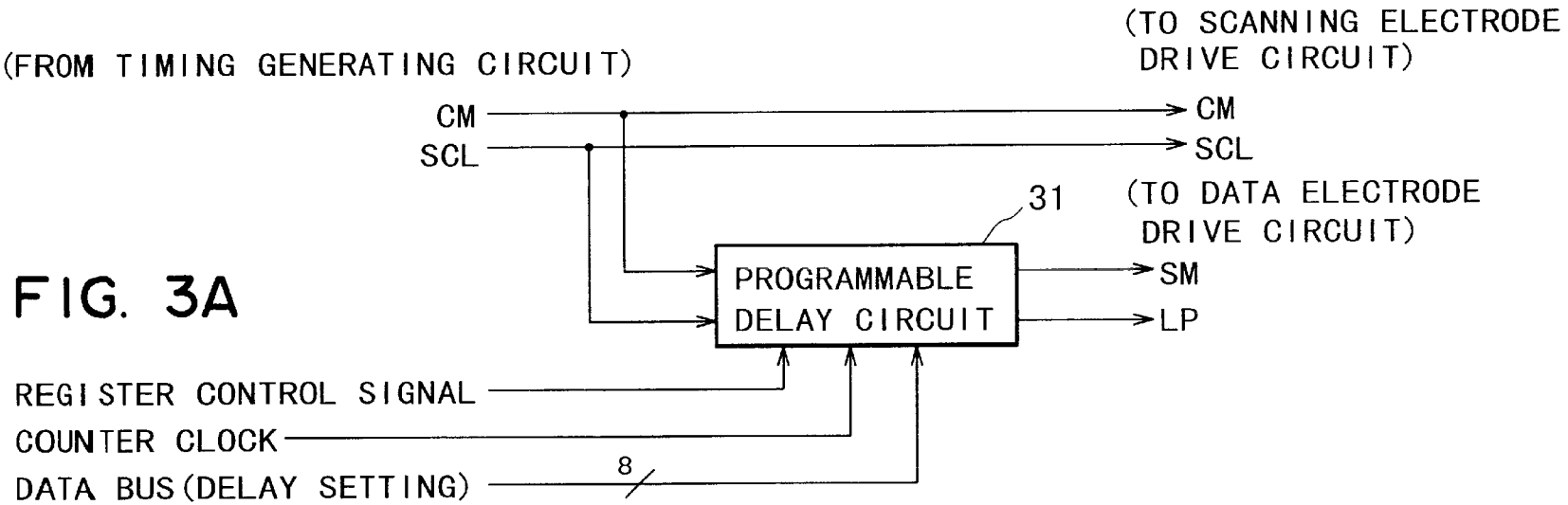
FIGS. 3A and 3B are respectively a block diagram showing an embodiment of a timing-adjusting circuit for the display apparatus shown in FIG. 1.
Figure 3B:
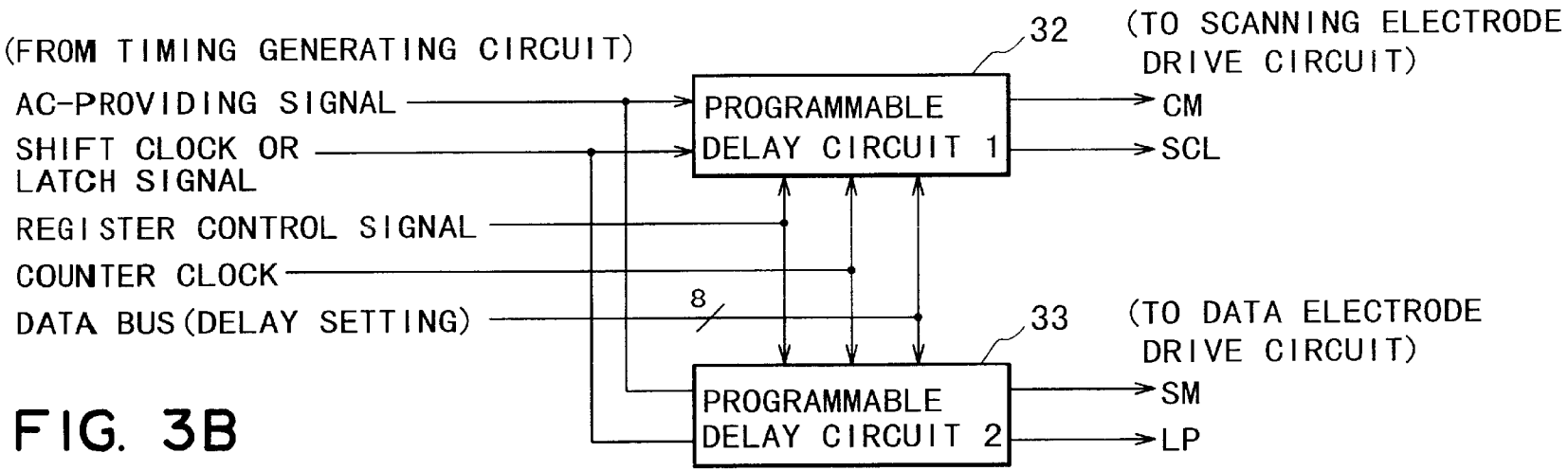

FIGS. 3A and 3B are block diagrams of the timing-adjusting circuit.

Referring to FIG. 3A, the scanning electrode drive timing signal (CM, SCL) is delayed by a programmable delay circuit 31 and outputted also as the data electrode drive timing signal (SM, LP).

In FIG. 3B, based on a common drive timing signal (drive initiation or switching timing signal), delay times until the scanning electrode drive timing signal (SM, SCL) and the data electrode drive timing signal (SM, LP) are outputted, respectively, are independently set by a first programmable delay circuit 1 (32) and a second programmable delay circuit 2 (33), respectively.

Each of the programmable delay circuits 31, 32 and 33 comprises a counter, a comparator, a register (8 bit) for externally setting delay times, etc., and is designed to be capable of independently setting respective delay times for two signals (SM and LP or CM and SCL). Each programmable delay circuit employs a counter clock (10 MHz) and is capable of adjusting a delay time between 0–25.5 $\mu$sec every 100 nsec. The setting of delay times is performed by using a microprocessing unit (MPC) provided to the panel control circuit 104 in this example but may be performed by using switches and/or jumpers formed on a board.

In this example, a specific adjustment of drive timing (delay times) was performed in the following manner.

The scanning electrode drive circuit 103 (IC withstand voltage=60) and the data electrode drive circuit 102 (IC withstand voltage=10 V) showed the following delay times (nsec).

| Signal | Scanning electrode drive circuit | Data electrode drive circuit |
|---|---|---|
| CM or SM | 700 (td1c) | 100 (td1s) |
| SCL or LP | 500 (td2c) | 100 (td2s) |

In the case of using the programmable delay circuit 31 as shown in FIG. 3A, the register was set provide a delay time (difference) of 600 nsec (700 nsec–100 nsec) for the AC-providing signals (CM, SM) and a delay time (difference) of 400 nsec (500 nsec–100 nsec) for the latch and shift clock signals (LP, SCL), whereby the outputted data electrode drive waveform and the outputted scanning electrode drive waveform were concurrently switched as shown in FIG. 2, thus ensuring an identical switching timing.

Similarly, in the case of using the programmable delay circuits 32 and 33 in combination as shown in FIG. 3B, the programmable delay circuits 32 and 33 were set to adjust the delay time differences (600 nsec and 400 nsec), respectively, thus matching the switching (output) timings of the respective drive waveforms with each other.

According to this example, by driving the liquid crystal panel 101 while adjusting a drive timing (delay times or delay time differences) on the panel control circuit 104 side, it became possible to display good images on the liquid crystal panel 101 even when the scanning electrode drive circuit and the data electrode drive circuit possessing different IC withstand waveforms (leading to different operating speeds) were used in combination.

EXAMPLE 2

In this example, a liquid crystal display apparatus had a structure (including a display area and the number of pixels) identical to that of the display apparatus used in Example 1 except that an active matrix-type liquid crystal panel including a plurality of switching devices (TFTs) each provided to one pixel was used as the liquid crystal panel 101 shown in FIG. 1 and the data and scanning electrode drive circuits 102 and 103 were modified and adopted for an active matrix driving scheme.

Figure 10:
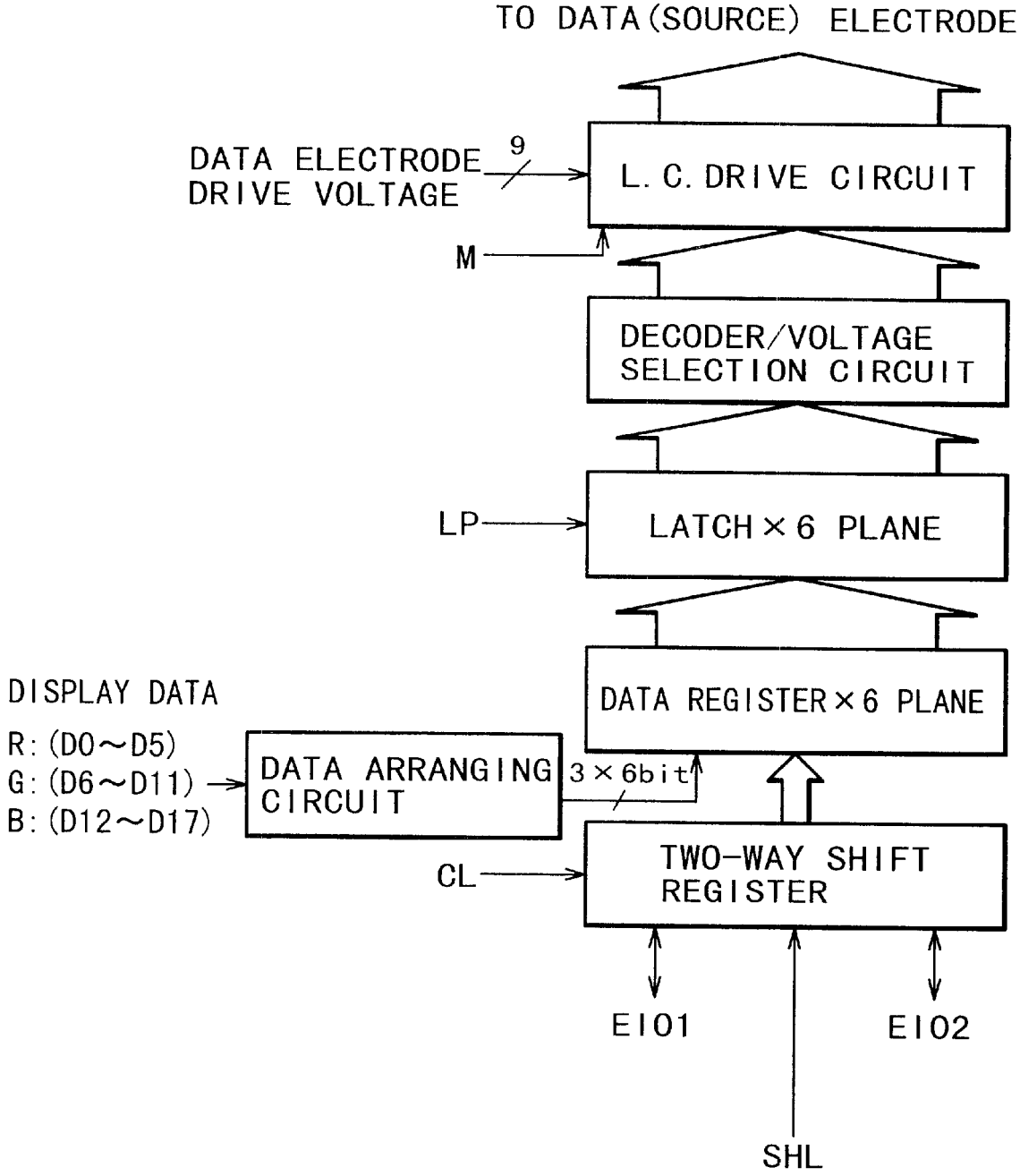
FIGS. 10 and 11 are views for illustrating embodiments of a data electrode drive circuit and a scanning electrode drive circuit, respectively, of an active matrix-type liquid crystal display panel.
Figure 11:
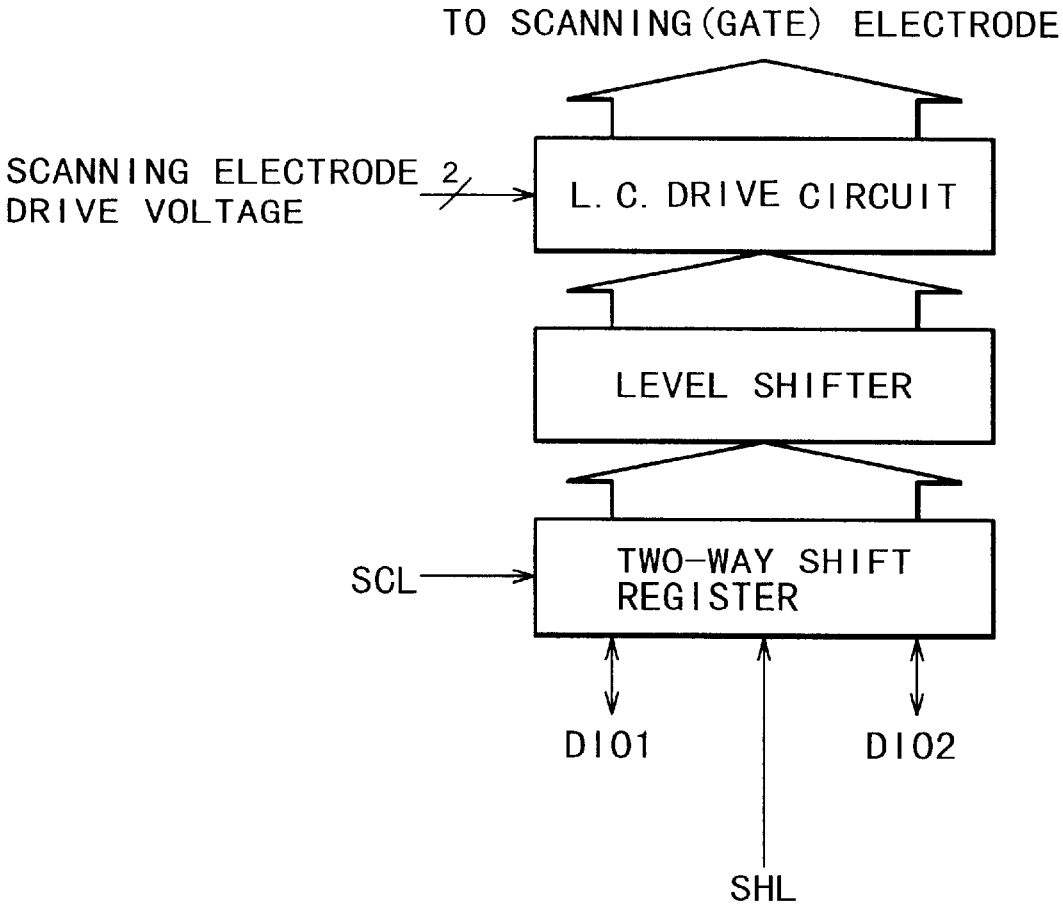

FIGS. 10 and 11 show block diagrams of the modified data electrode drive circuit 102 and the modified scanning electrode drive circuit 103, respectively, used in this example.

Referring to FIG. 10, the data electrode drive circuit 102 (for the active matrix-type liquid crystal panel 101) has a wider bus for display data compared with that for the simple matrix-type liquid crystal panel as in Example 1, thus resulting in an increase in the number of drive voltages. The data electrode drive circuit 102 comprises a digital driver (64 gradational levels). Otherwise, the data electrode drive circuit 102 is substantially identical in structure to that used in Example 1. In this example, the data electrode drive timing signal comprises a latch signal (LP) and an AC-providing signal (M).

On the other hand, the scanning electrode drive circuit 103 has the same function as that for the simple matrix-type liquid crystal in that pulses are successively outputted therefrom principally based on a shift register and has a structure identical to that for the simple matrix-type liquid crystal panel except that the number of drive voltages is decreased and a drive timing is determined only based on a shift clock signal (SCL). This is attributable to a difference in driving scheme between the active matrix-type liquid crystal panel and the single matrix-type liquid crystal panel.

In this example, the active matrix-type liquid crystal panel 101 was driven by applying thereto data and scanning electrode drive waveforms via a data electrode drive circuit 102 (IC withstand voltage=15 V) and a scanning electrode drive circuit 103 (IC withstand voltage=40 V), respectively, according to the phase-adjusting schemes as shown in FIGS. 3A and 3B similarly as in Example 1 (wherein the respective drive timing signals were independently outputted from the panel control circuit 104 so as to match switching (output) timings of the data and scanning electrode drive waveforms with each other). As a result, it was possible to obtain uniform and bright display images with no crosstalk phenomenon.

EXAMPLE 3

Figure 15:
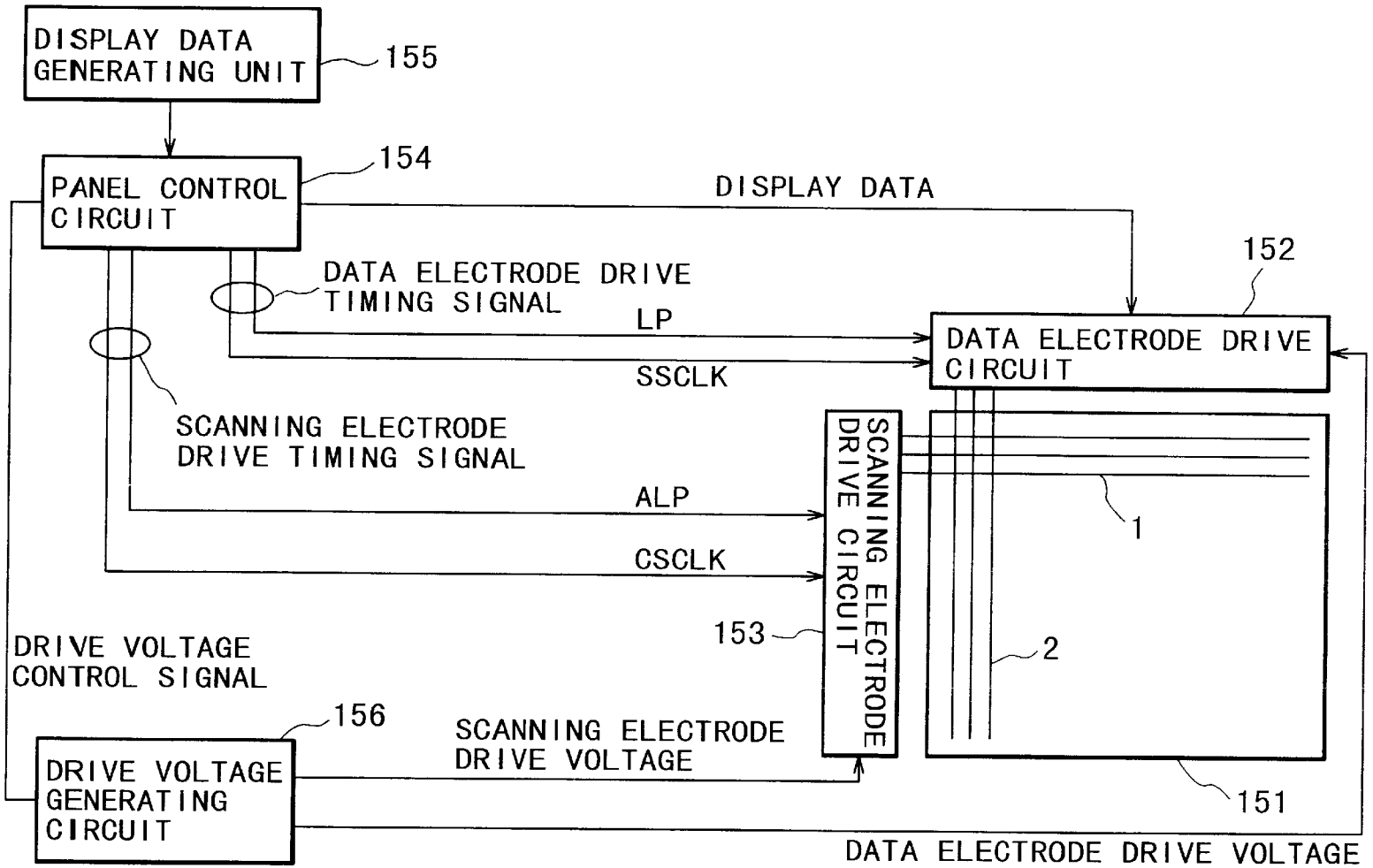
FIG. 15 is a block diagram for illustrating a structure of a liquid crystal display apparatus of the present invention used in Example 3.

In this example, a liquid crystal display apparatus had a structure (including a display area and the number of pixels) as shown in FIG. 15 identical to that of the display apparatus used in Example 1 except that a single matrix-type FLC panel was used instead of the (STN or TN) liquid crystal panel 101 shown in FIG. 1 and data and scanning electrode drive circuits 152 and 153 were adopted for a driving scheme of the FLC panel 151.

Figure 12:
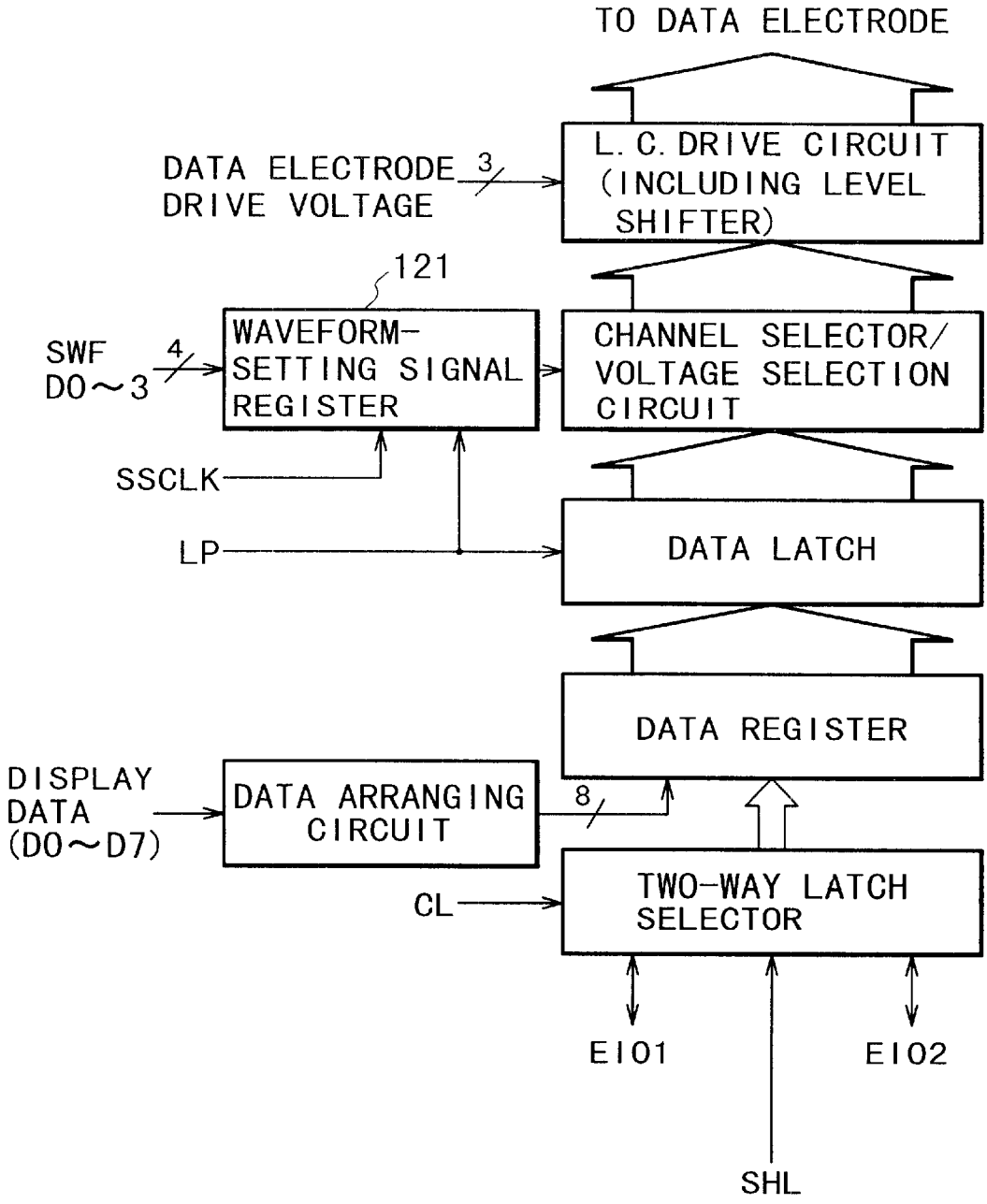
FIGS. 12 and 13 are views for illustrating embodiments of a data electrode drive circuit and a scanning electrode drive circuit, respectively, of a ferroelectric liquid crystal (FLC) display panel.
Figure 13:
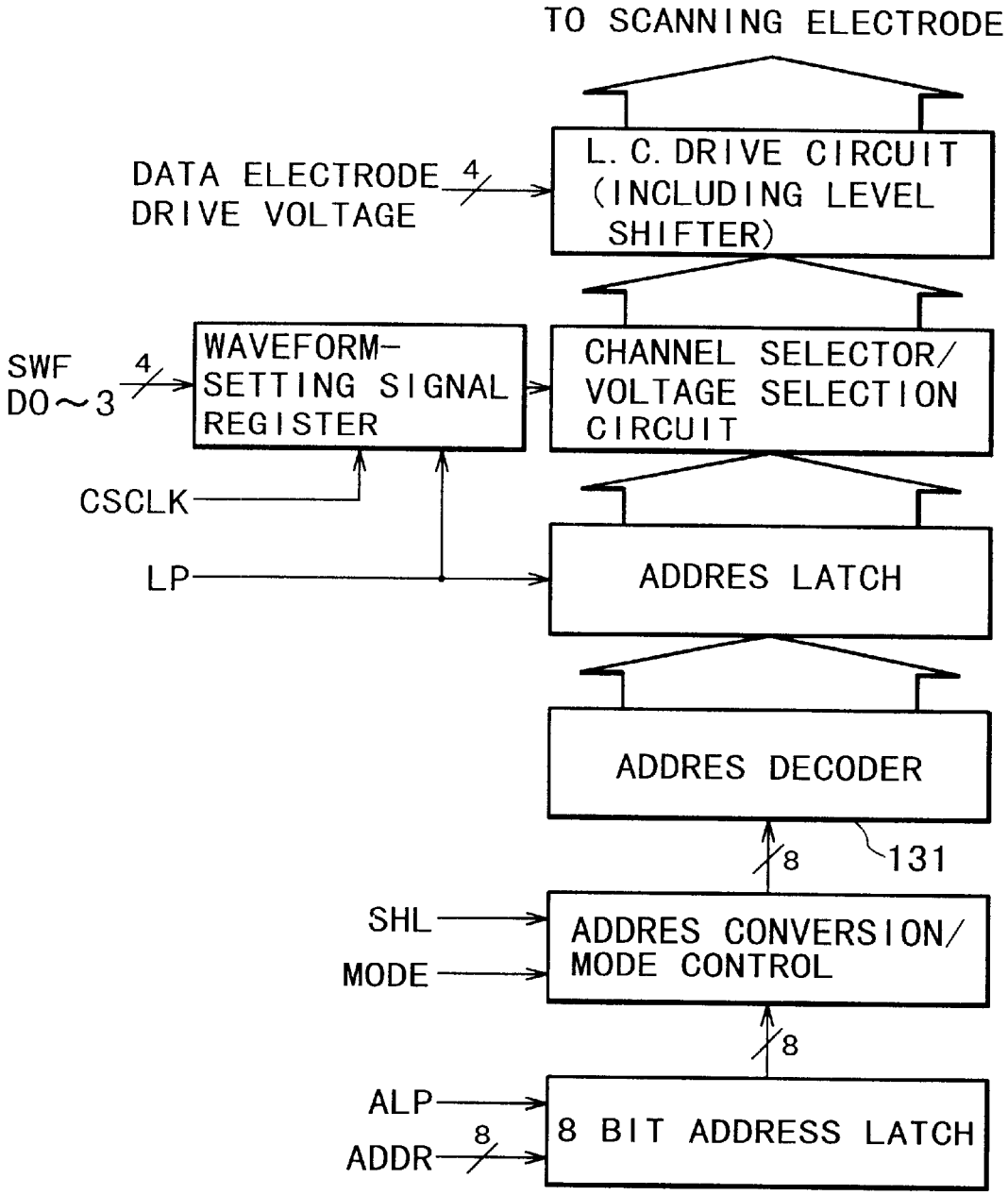

FIGS. 12 and 13 show block diagrams of the modified data electrode drive circuit 152 and the scanning electrode drive circuit 153, respectively, used in this example.

Referring to FIG. 12, the data electrode drive circuit 152 (for the FLC 151) is further provided with a waveform-setting signal register 121 (for 4 bit signals) for externally changing a drive waveform compared with that for the simple matrix-type STN (TN) liquid crystal panel as in Example 1. Further, the AC-providing signal (M) is not present in the data electrode drive circuit 152 and a signal for controlling a drive timing is a segment sampling clock signal (SSCLK).

On the other hand, the scanning electrode drive circuit 153 has a structure different from that for the simple matrix-type STN (TN) liquid crystal panel.

In the case of driving the FLC panel 151, a so-called partial rewriting scanning wherein only a portion causing a change in display data is rewrited in view of its memory characteristic is effected in many cases. Also in this example, in order to meet such a partial rewriting scanning, the scanning electrode drive circuit 153 includes a scanning electrode address decoder 131 for selecting a desired scanning electrode (not a sequential selection).

In the scanning electrode drive circuit 153, a signal for controlling a drive timing is a common sampling clock signal (CSCLK) which has a period identical to that of the segment sampling clock signal (SSCLK) inputted into the data electrode drive circuit 152.

Figure 14:
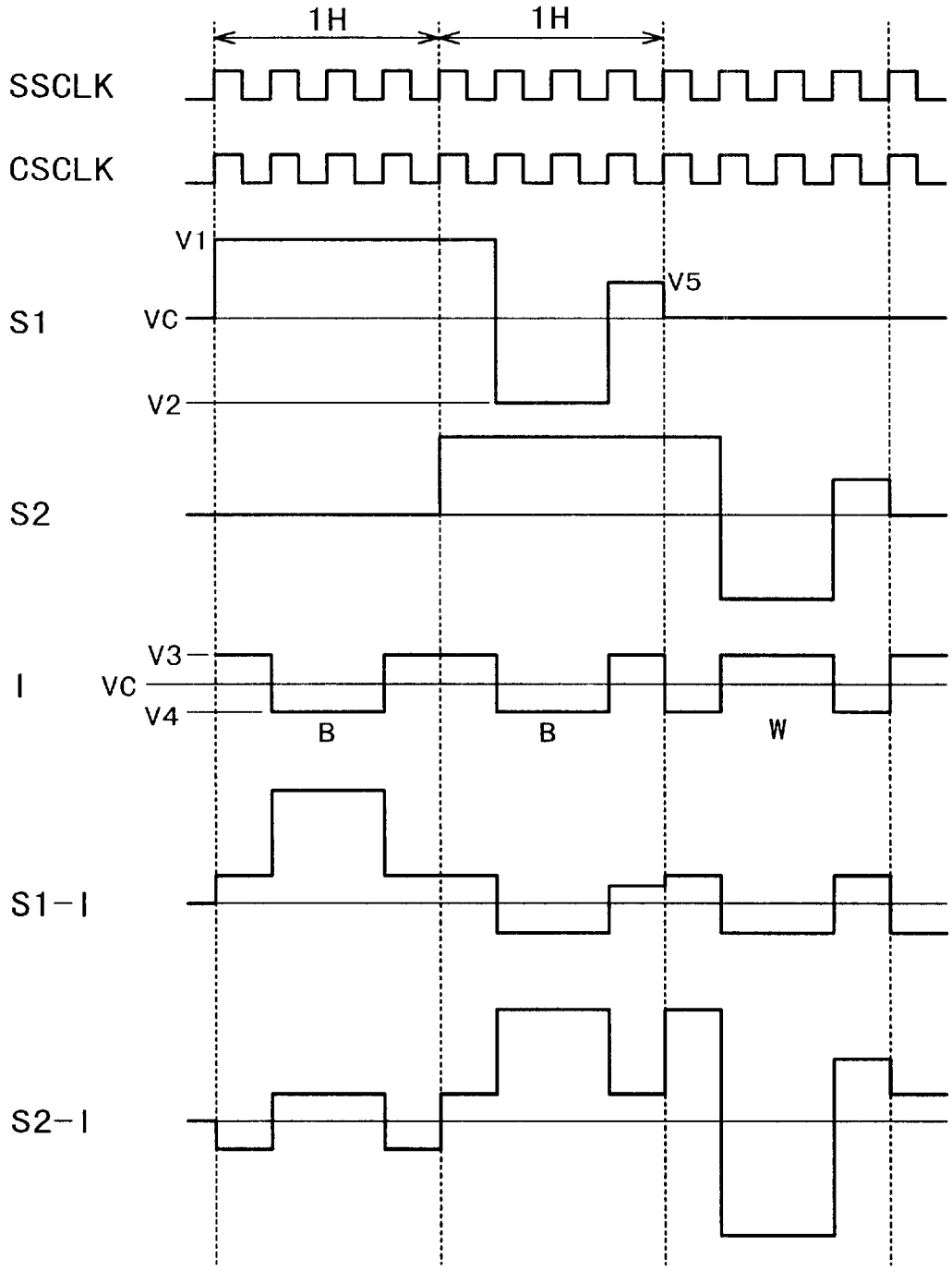
FIG. 14 is an embodiment of a set of drive waveforms for an FLC display panel.

FIG. 14 shows a relationship of drive waveforms outputted from the drive circuits 152 and 153 with drive timing signals.

Referring to FIG. 14, S1 and S2 represent first and second scanning electrode drive waveforms, respectively, and I represents a data electrode drive waveform. "B" and "W" represent a drive waveform portion outputted from the data electrode drive circuit 152 based on image data for "black (state)" and "white (state)", respectively, within one selection period (1H: one horizontal scanning period). Composite signals (S1-I) and (S2-I) are applied to a pixel for providing such a display state that the pixel is reset into "black" state in the first selection period and then retained in the "black" state and a pixel for providing such a display state that the pixel is reset into "black" state in the second selection period and then written in "white" state in the third selection period, respectively.

In FIG. 14, respective voltage values V1–V5 are supplied from a drive voltage generating circuit 156 and are controlled by a panel control circuit 154 based on temperature data of the FLC panel 151 as shown in FIG. 15.

In this example, the temperature data are determined based on values measured by a temperature sensor (not shown in FIG. 15) disposed in the vicinity of the FLC panel 151 and are inputted into the panel control circuit 154.

Incidentally, in FIG. 14, a logical relationship between the outputted drive waveforms and the drive timing signals is shown for convenience of explanation. In an actual drive of the ferroelectric liquid crystal panel 151 in this example, delay times are caused similarly as in the case of the relationship between, e.g., the AC-providing signals and the drive waveforms described in Example 1. Further, the segment and common sampling signals (SSCLK and CSCLK) are illustrated as signals with the same input timing. In the actual drive, however, these signals are independently inputted into the data electrode drive circuit 152 and the scanning electrode drive circuit 153, respectively, via the timing-adjusting circuits as shown in FIGS. 3A and 3B.

In this example, the FLC panel 151 was driven by applying thereto data and scanning electrode drive waveforms via a data electrode drive circuit 152 (IC withstand voltage=10 V) and a scanning electrode drive circuit 153 (IC withstand voltage=40 V), respectively, according to the phase-adjusting schemes as shown in FIGS. 3A and 3B similarly as in Example 1 (wherein the respective drive timing signals were independently outputted from the panel control circuit 154 so as to match switching (output) timings of the data and scanning electrode drive waveforms with each other). As a result, it was possible to obtain uniform and bright display images with no crosstalk phenomenon.

As described hereinabove, according to the present invention, by using the phase-adjusting means for adjusting a phase of the scanning electrode drive timing signal and/or the data electrode drive timing signal in the matrix-type liquid crystal display apparatus including scanning electrode drive means and data electrode drive means different in operating speed due to a difference in IC withstand waveform therebetween, it is possible to drive the display apparatus while independently outputting the respective (scanning and data) electrodes to the respective electrode drive means so as to compensate (make up) the difference in operating speed between the respective electrode drive means. As a result, it becomes possible to apply proper drive waveforms (composite waveforms) to the liquid crystal panel, thus providing good image qualities.

What is claimed is:

1. A display apparatus, comprising:

a display panel including scanning electrodes and data electrodes arranged in a matrix form, scanning electrode drive means having a first withstand voltage for applying a scanning signal to the scanning electrodes, data electrode drive means having a second withstand voltage for applying a data signal to the data electrodes, display data generating means for generating data, and control means outside of said display data generating means for receiving display data and control signals from said display data generating means, wherein the first withstand voltage and the second withstand voltage are different from each other, so as to cause a difference in output timing between the scanning signal and the data signal, and said control means comprises phase-adjusting means for adjusting a phase of the scanning electrode drive timing signal inputted into said scanning electrode drive means and/or the data electrode drive timing signal inputted into said data electrode drive means.

2. An apparatus according to claim 1, wherein said phase-adjusting means adjusts a phase of the scanning electrode drive timing signal and/or the data electrode drive timing signal so as to match a switching timing of a scanning electrode drive waveform output from said scanning electrode drive means with that of a data electrode drive waveform from said data electrode drive means.

3. An apparatus according to claim 2, wherein said phase-adjusting means adjusts phases of the scanning electrode drive timing signal and the data electrode drive timing signal so that the phase of the scanning electrode drive timing signal precedes that of the data electrode drive timing signal.

4. An apparatus according to claim 2, wherein the scanning electrode drive timing signal or the data electrode drive timing signal comprises a plurality of timing signals, and said phase-adjusting means adjusts respective phases of the plurality of timing signals independently of each other.

5. An apparatus according to claim 2, wherein said phase-adjusting means comprises delay means for delaying the scanning electrode drive timing signal and outputting the scanning electrode drive timing signal as the data electrode drive timing signal.

6. An apparatus according to claim 2, wherein said phase-adjusting means comprises first delay means for delaying a first signal for a first delay time and outputting the first signal as the data electrode drive timing signal and second delay means for delaying a second signal for a second delay time and outputting the second signal as the scanning electrode drive timing signal, said first delay means being capable of setting the first delay time independently of said second delay means capable of setting the second delay time.

* * * * *

UNITED STATES PATENT AND TRADEMARK OFFICE

CERTIFICATE OF CORRECTION

PATENT NO. : 6,535,193 B1
DATED : March 18, 2003
INVENTOR(S) : Atsushi Mizutome et al.

It is certified that error appears in the above-identified patent and that said Letters Patent is hereby corrected as shown below:

Column 2,
Line 33, "AC-providing providing" should read -- AC-providing --.

Signed and Sealed this

Sixth Day of July, 2004

JON W. DUDAS
*Acting Director of the United States Patent and Trademark Office*